US009447746B2

(12) United States Patent
Boettcher et al.

(10) Patent No.: US 9,447,746 B2
(45) Date of Patent: Sep. 20, 2016

(54) SYSTEM AND METHOD FOR CONTROLLING ENGINE

(71) Applicant: Caterpillar Inc., Peoria, IL (US)

(72) Inventors: Todd J. Boettcher, Germantown Hills, IL (US); Mark C. Paul, Carmel, IN (US); Neal A. Leifheit, Greenville, SC (US); Joshua T. Annin, Peoria, IL (US); Kalaivani Vittalraj, Peoria, IL (US); Matthew L. McConville, Greenville, SC (US); Justin Peters, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 426 days.

(21) Appl. No.: 14/170,836

(22) Filed: Feb. 3, 2014

(65) Prior Publication Data

US 2015/0219034 A1 Aug. 6, 2015

(51) Int. Cl.

*F02D 41/30* (2006.01)
*F02D 41/24* (2006.01)
*F02D 41/14* (2006.01)

(52) U.S. Cl.

CPC ..... *F02D 41/2422* (2013.01); *F02D 41/1497* (2013.01); *F02D 41/2451* (2013.01); *F02D 2200/0406* (2013.01); *F02D 2200/0414* (2013.01); *F02D 2200/101* (2013.01); *F02D 2250/18* (2013.01); *F02D 2250/26* (2013.01)

(58) Field of Classification Search

CPC ..... F02D 41/2422; F02D 41/1497; F02D 2250/26; F02D 2250/18; F02D 2200/101; F02D 2200/0414; F02D 2200/0406; F01D 17/085; G01K 13/02; F02N 19/00

USPC ..... 123/349, 406.55, 198 D, 179.1–179.27; 701/182, 189, 54, 102; 374/144

See application file for complete search history.

(56) References Cited

U.S. PATENT DOCUMENTS

| | | | | |
|---|---|---|---|---|
| 5,070,832 | A * | 12/1991 | Hapka | F01M 1/22 123/198 D |
| 5,477,827 | A * | 12/1995 | Weisman, II | B60K 31/04 123/436 |
| 6,401,457 | B1 * | 6/2002 | Wang | F02B 37/18 123/568.21 |
| 6,941,245 | B2 * | 9/2005 | Longnecker | F01P 7/167 702/184 |
| 7,725,199 | B2 | 5/2010 | Brackney | |
| 8,095,285 | B2 * | 1/2012 | Schifferer | B60W 30/184 701/103 |
| 2003/0182048 | A1 * | 9/2003 | Wang | F02D 41/222 701/107 |
| 2004/0173195 | A1 * | 9/2004 | Ament | F02D 41/0035 123/686 |
| 2005/0066658 | A1 * | 3/2005 | Longnecker | F02D 23/00 60/602 |
| 2006/0130817 | A1 * | 6/2006 | Gonze | F02D 41/004 123/520 |

(Continued)

*Primary Examiner* — Thomas Moulis
*Assistant Examiner* — Joshua A Campbell
(74) *Attorney, Agent, or Firm* — L. Glenn Waterfield

(57) ABSTRACT

A control system of an engine is provided. The control system includes an inlet sensor configured to generate a signal indicative of an engine inlet air temperature and an intake manifold sensor configured to generate a signal indicative of an engine intake manifold air temperature. The control system includes a control module communicably coupled to the inlet sensor and the intake manifold sensor. The control module is configured to determine the engine inlet air temperature and the engine intake manifold air temperature. The control module is configured to determine an initial de-rate value based on a predetermined relationship between the engine inlet air temperature and the engine intake manifold air temperature. The control module is configured to determine a pre-stored de-rate modifier corresponding to an engine speed. The control module is configured to determine a final de-rate value based on the initial de-rate value and the pre-stored de-rate modifier.

20 Claims, 6 Drawing Sheets

(56) References Cited

U.S. PATENT DOCUMENTS

2007/0255471 A1* 11/2007 Wallis ..... G01M 13/025 701/62
2009/0186320 A1* 7/2009 Rucci ..... B64C 27/04 434/33
2010/0070120 A1* 3/2010 Bailey ..... B60K 6/46 701/22
2011/0146246 A1* 6/2011 Farman ..... F01N 3/0235 60/286
2011/0251825 A1* 10/2011 Nagoshi ..... F02D 41/222 702/183
2013/0173028 A1 7/2013 Felty et al.
2013/0193895 A1* 8/2013 Noguchi ..... H02P 29/022 318/490
2015/0219034 A1* 8/2015 Boettcher ..... F02D 41/1497 123/349

* cited by examiner

SYSTEM AND METHOD FOR CONTROLLING ENGINE

TECHNICAL FIELD

The present disclosure relates to a system and method for controlling an engine, and more specifically to the system and method for controlling de-rate of the engine.

BACKGROUND

De-rating of an engine is known in the art. De-rating generally includes regulating an amount of fuel supplied to the engine in order to reduce an engine power output. De-rating of the engine is performed due to various reasons. De-rating may be performed in order to prevent overheating of the engine. For example, engines installed within a closed environment, such as an engine room, need to be de-rated if the ambient temperature of the closed environment is high. In such a situation, the engines may de-rate after a cold start inside the hot closed environment, which may be undesirable. Known methods use additional sensors and associated systems to prevent such premature de-rate events. The additional sensors lead to increase in cost of the system. The additional sensors may also reduce system reliability due to added number of components.

U.S. Pat. No. 5,477,827 discloses a system for sampling vehicular operating conditions of a vehicle. The vehicle is equipped with an internal combustion engine and an electronic control module for controlling the engine. The system includes a plurality of sensors for providing signals indicative of vehicular operating information. At least one of the plurality of sensors is in communication with the electronic control module. The system includes a memory in communication with the electronic control module for maintaining sampled information from the electronic control module in a plurality of pages. The system includes a microprocessor in communication with the memory and with the electronic control module. The microprocessor cooperates with the electronic control module to maintain a plurality of trends pages in the memory. Each trends page includes a predetermined number of samples. The trends pages provide an indication of at least one of a plurality of vehicle operating conditions or driver performance.

SUMMARY OF THE DISCLOSURE

In one aspect of the present disclosure, a control system of an engine is provided. The control system includes at least one inlet sensor configured to generate a signal indicative of an engine inlet air temperature. The control system also includes at least one intake manifold sensor configured to generate a signal indicative of an engine intake manifold air temperature. The control system further includes a control module communicably coupled to the at least one inlet sensor and the at least one intake manifold sensor. The control module is configured to determine the engine inlet air temperature and the engine intake manifold air temperature based on the signals. The control module is configured to determine an initial de-rate value based on a predetermined relationship between the engine inlet air temperature and the engine intake manifold air temperature. The control module is also configured to determine a pre-stored de-rate modifier corresponding to an engine speed. The control module is further configured to determine a final de-rate value based on the initial de-rate value and the pre-stored de-rate modifier.

In another aspect of the present disclosure, a method of controlling an engine is provided. The method includes determining an engine inlet air temperature and an engine intake manifold air temperature. The method includes determining an initial de-rate value based on a predetermined relationship between the engine inlet air temperature and the engine intake manifold air temperature. The method also includes determining a pre-stored de-rate modifier corresponding to an engine speed. The method further includes determining a final de-rate value based on the initial de-rate value and the pre-stored de-rate modifier.

In yet another aspect of the present disclosure, a method of controlling an engine is provided. The method includes determining an engine inlet air temperature and an engine intake manifold air temperature. The method includes determining an initial de-rate value based on a predetermined relationship between the engine inlet air temperature and the engine intake manifold air temperature. The method includes determining a pre-stored de-rate modifier corresponding to an engine speed. The method includes determining a final de-rate value by multiplying the initial de-rate value with the pre-stored de-rate modifier. The method also includes receiving de-rate values based on one or more other operational parameters of the engine. The method further includes de-rating the engine based on a maximum of the de-rate values and the final de-rate value.

Other features and aspects of this disclosure will be apparent from the following description and the accompanying drawings.

DETAILED DESCRIPTION

Figure 1:
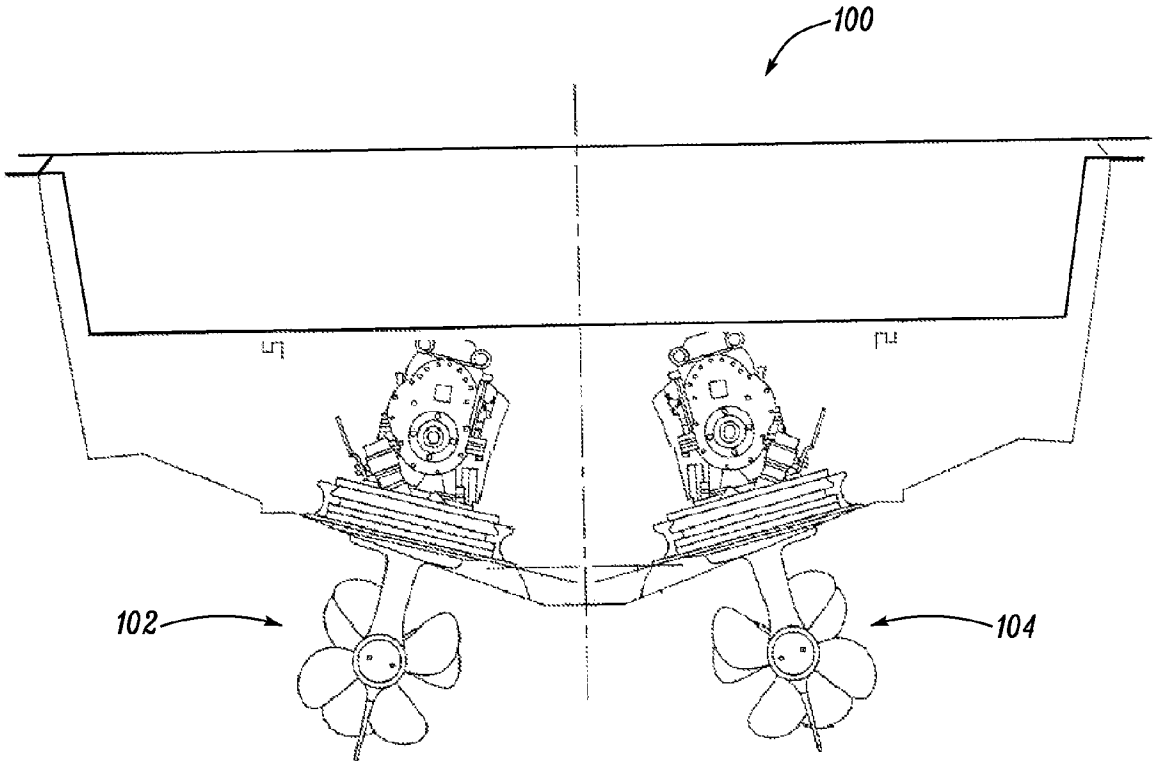
FIG. 1 is an exemplary machine, according to an embodiment of the present disclosure.

Wherever possible, the same reference numbers will be used throughout the drawings to refer to the same or the like parts. FIG. 1 shows a machine 100. More specifically, the machine 100 is a marine vessel including, but not limited to, a ship, a boat and so on. Alternatively, the machine 100 may include any machine associated with an industry including, but not limited to, transportation, construction, mining, agriculture, forestry, waste management and material handling.

The machine 100 includes a first propeller 102 and a second propeller 104. The first propeller 102 is disposed spaced apart from the second propeller 104. The first and second propellers 102, 104 are configured to provide motive power to the machine 100. The machine 100 may include an engine 202 (shown in FIG. 2) coupled to the first and second propellers 102, 104. In another embodiment, the machine 100 may include a single propeller (not shown) coupled to the engine 202. The engine 202 is configured to provide motive power to the first and second propellers 102, 104.

The engine 202 may be configured to combust a fuel to release the chemical energy therein and convert that energy to mechanical power. The engine 202 may be a compression ignition engine that combusts diesel fuel. Alternatively, the engine 202 may include a spark ignition engine that is configured to combust gasoline or other fuels such as ethanol, bio-fuel, natural gas and so on.

Figure 2:
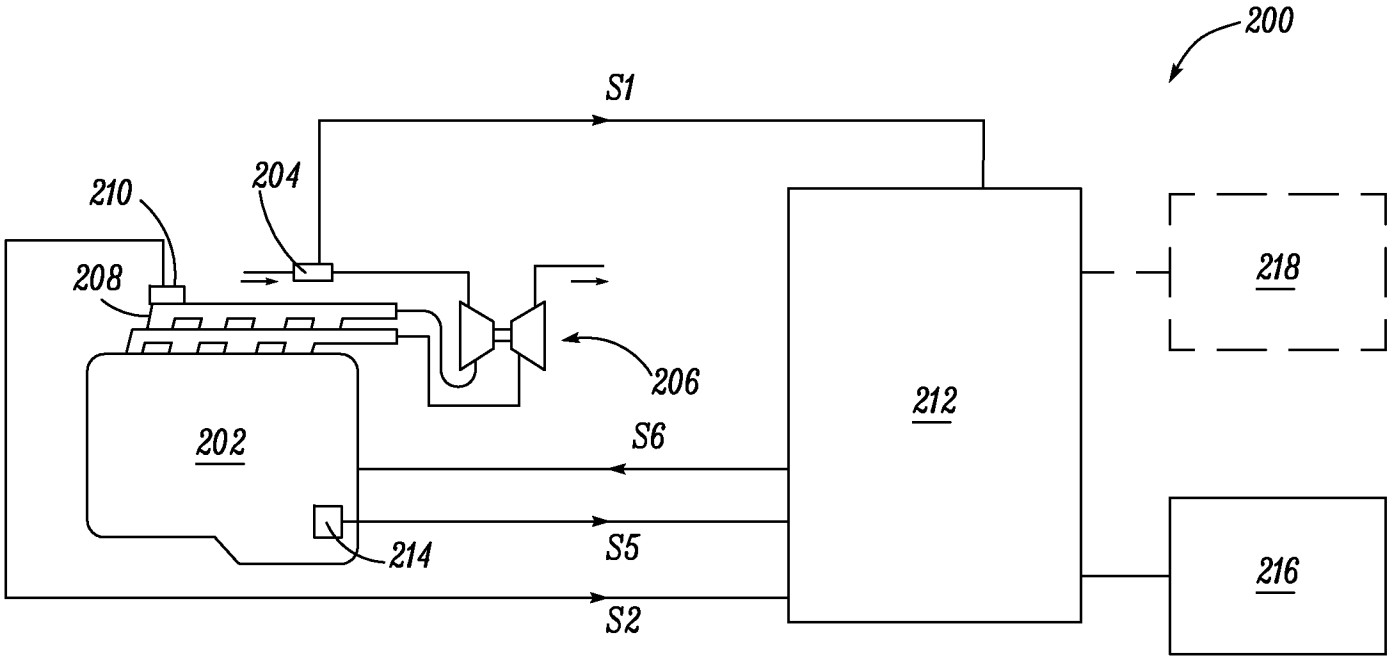
FIG. 2 is a block diagram of a control system for an engine of the machine, according to an embodiment of the present disclosure.
Figure 3:
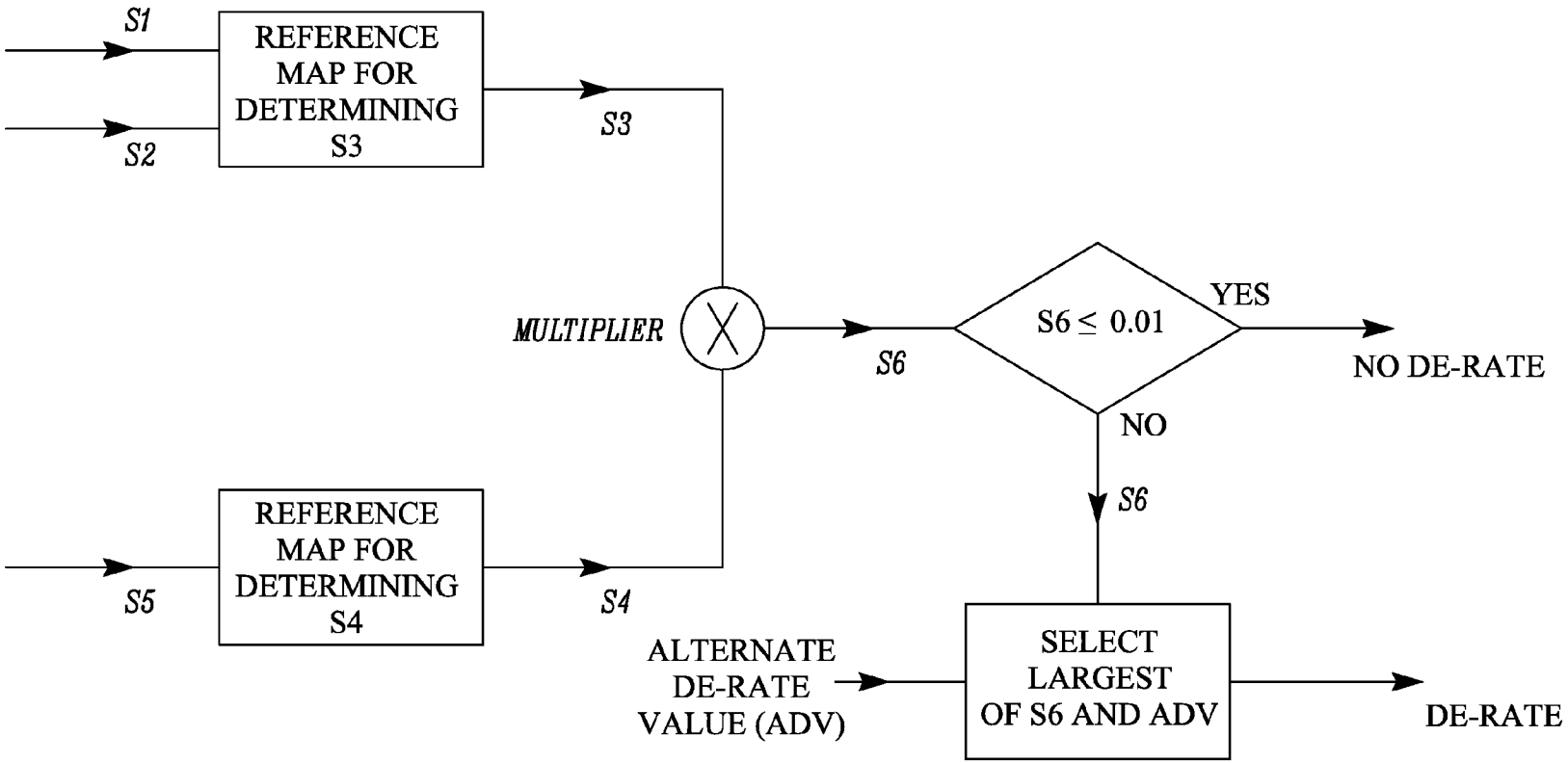
FIG. 3 is a control diagram for de-rating the engine, according to an embodiment of the present disclosure.

The present disclosure relates to a control system 200 for the engine 202. Referring to FIG. 2, a block diagram of the control system 200 for the engine 202 is illustrated, according to an embodiment of the present disclosure. Referring to FIG. 3, a control diagram for de-rating the engine 202 is illustrated, according to an embodiment of the present disclosure. More specifically, the control system 200 is configured to de-rate the engine 202 based on one or more parameters and will now be explained in detail with reference to FIGS. 2 and 3.

The engine 202 includes at least one inlet sensor 204. In one embodiment, the inlet sensor 204 may be coupled to an inlet of a turbocharger 206. In another embodiment, the inlet sensor 204 may be provided with an engine room (not shown) of the machine 100. The inlet sensor 204 is configured to generate a signal indicative of an engine inlet air temperature S1 (hereinafter referred to as "the inlet air temperature S1"). The inlet air temperature S1 may refer to an ambient air temperature within the engine room of the machine 100. The engine room may be configured to house the engine 202 therein. In another embodiment, where the engine 202 may be installed open to atmosphere, the inlet air temperature S1 may refer to a temperature of atmosphere.

The engine 202 may include the turbocharger 206. The turbocharger 206 may be configured to receive and compress the inlet air. The turbocharger 206 may be further fluidly coupled to an intake manifold 208 of the engine 202. The intake manifold 208 may be configured to receive the inlet air after compression from the turbocharger 206. The compression of the inlet air may result in an increase in temperature of the inlet air. Accordingly, at least one intake manifold sensor 210 is coupled to the intake manifold 208 of the engine 202. The intake manifold sensor 210 is configured to generate a signal indicative of an engine intake manifold air temperature S2 (hereinafter referred to as "the intake manifold air temperature S2").

The control system 200 includes a control module 212 communicably coupled to the inlet sensor 204 and the intake manifold sensor 210. The control module 212 may embody a single microprocessor or multiple microprocessors configured for receiving signals from the components of the control system 200. Numerous commercially available microprocessors may be configured to perform the functions of the control module 212. It should be appreciated that the control module 212 may embody a machine microprocessor capable of controlling numerous machine functions. A person of ordinary skill in the art will appreciate that the control module 212 may additionally include other components and may also perform other functions not described herein. The control module 212 is configured to determine the inlet air temperature S1 and the intake manifold air temperature S2 based on the signals received from the inlet sensor 204 and the intake manifold sensor 210 respectively.

Based on the determined signals, the control module 212 is further configured to determine an initial de-rate value S3 based on a predetermined relationship between the inlet air temperature S1 and the intake manifold air temperature S2. The predetermined relationship may refer to a predetermined reference map stored in a database (not shown) accessible by the control module 212 or an internal memory of the control module 212. The reference map may include predetermined readings of the initial de-rate values S3 corresponding to different inlet air temperatures S1 and the intake manifold air temperatures S2. The predetermined initial de-rate values S3 may be derived by actual experimentation and physical measurements. This may include measuring exhaust temperatures at different inlet air temperatures S1 and the intake manifold air temperatures S2. Further, the initial de-rate values S3 are determined based on a predetermined safe exhaust temperature and the measured exhaust temperatures. The initial de-rate values S3 may lie in a range between 0 and 1. For lower inlet air temperatures S1 and/or the intake manifold air temperatures S2, the initial de-rate values S3 may be 0 or a low fractional value. For example, for the inlet air temperature S1 as 7° C. and the intake manifold air temperature S2 as 23° C., the initial de-rate value S3 may be 0. For the inlet air temperature S1 as 12° C. and the intake manifold air temperature S2 as 108° C., the initial de-rate value S3 may be 0.03, and so on. For higher inlet air temperatures S1 and/or the intake manifold air temperatures S2, the initial de-rate values S3 may be a higher fractional values greater than 0. For example, for the inlet air temperature S1 as 52° C. and the intake manifold air temperature S2 as 98° C., the initial de-rate value S3 may be 0.12. For the inlet air temperature S1 as 62° C. and the intake manifold air temperature S2 as 108° C., the initial de-rate value S3 may be 0.41, and so on. In another embodiment, the predetermined relationship may be a predetermined mathematical equation. The mathematical equation may include a multiple polynomial regression model, a physics based model, a neural network model or any other model or algorithm known in the art.

The control module 212 is also configured to determine a pre-stored de-rate modifier value S4 corresponding to an engine speed S5. Accordingly, the engine 202 may include a speed sensor 214 configured to generate a signal indicative of the engine speed S5. In one embodiment, the control module 212 may refer to a predetermined reference map stored in the database or the internal memory of the control module 212. The reference map may include predetermined de-rate modifier values S4 for different engine speeds S5. The de-rate modifier values S4 may lie in a range between 0 and 1. For lower engine speeds S5, the de-rate modifier values S4 may be 0 or a low fraction. For example, for the engine speed S5 as 650 Rotations Per Minute (RPM), the de-rate modifier value S4 may be 0. For higher engine speeds S5, the de-rate modifier values S4 may be or equal to 1 or a higher fractional value greater than 0. For example, for the engine speeds S5 as 1925 RPM and 2100 RPM, the de-rate modifier values S4 may be 0.67 and 1, respectively. In another embodiment, the pre-stored de-rate modifier value S4 may be determined using a predetermined mathematical equation. The mathematical equation may include a multiple polynomial regression model, a physics based model, a neural network model or any other model or algorithm known in the art.

In an embodiment, the pre-stored de-rate modifier value S4 is set as zero below a predetermined engine speed. The predetermined engine speed may vary. For example, in one embodiment, the predetermined engine speed may be equal to an idling speed of the engine 202. In another embodiment, the predetermined engine speed may be greater than the idling speed of the engine 202. For example, the predetermined engine speed may be 1725 RPM which may be greater than the idling speed of the engine 202. Below 1725 RPM, the pre-stored de-rate modifier value S4 may be set as 0. The setting of the pre-stored de-rate modifier value S4 as 0 below the predetermined engine speed may prevent de-rating of the engine 202 during starting of the engine 202 at low engine speeds S5. It should be noted that the control system 200 may utilize sensors such as the inlet sensor 204, the intake manifold sensor 210 and the speed sensor 214 already installed within the system without a need of additional sensors.

The control module 212 is further configured to determine a final de-rate value S6 based on the initial de-rate value S3 and the pre-stored de-rate modifier value S4. The control module 212 may determine the final de-rate value S6 in different ways. In one embodiment, the control module 212 is configured to determine the final de-rate value S6 by multiplying the initial de-rate value S3 with the pre-stored de-rate modifier value S4. In another embodiment, the control module 212 may refer to a predetermined reference map stored in the database or the internal memory of the control module 212. The reference map may include predetermined readings of the final de-rate value S6 for different initial de-rate values S3 and the pre-stored de-rate modifier values S4. In yet another embodiment, the final de-rate value S6 may be determined using a predetermined mathematical equation. The mathematical equation may include a multiple polynomial regression model, a physics based model, a neural network model or any other model or algorithm known in the art.

In one embodiment, the control module 212 is configured to set the final de-rate value S6 to zero in a situation when the final de-rate value S6 is lower than a preset de-rate value S7. The preset de-rate value S7 may be 0.01 (i.e., 1%) or may change based on system design and requirements. This may prevent de-rating of the engine 202 due to noise and/or residual values present in the control system 200.

In one embodiment, the control module 212 may also be configured to determine one or more alternate de-rate values based on one or more operational parameters. The operational parameters may include, but not limited to, any one or a combination of, an engine coolant temperature and a fuel pressure. In such an embodiment, the control module 212 may be configured to de-rate the engine 202 based on a maximum of the final de-rate value S6 and the alternate de-rate values.

Based on the final de-rate value S6 or the alternate de-rate values, the control module 212 is configured to de-rate the engine 202. In one embodiment, the control module 212 may be configured to reduce a fuel supply to one or more cylinders of the engine 202 to de-rate the engine 202. In another embodiment, the control module 212 may be configured to completely shut off the fuel supply to the one or more cylinders of the engine 202 to de-rate the engine 202. In yet another embodiment, the control module 212 may be configured to reduce the fuel supply to the one or more cylinders and completely shut of the fuel supply to remaining cylinders of the engine 202 to de-rate the engine 202. The reducing and/or shutting of the fuel supply to the one or more cylinders of the engine 202 may be done by any methods known in the art and may not limit the scope of the disclosure.

In one embodiment, the control module 212 may be configured to selectively generate an alarm based on the final de-rate value S6 or the alternate de-rate values. Accordingly, the control module 212 may be communicably coupled to an operator interface 216. The operator interface 216 may include any interface known in the art including, but not limited to, a display unit, an auditory feedback device, a throttle device such as a lever and a rotary accelerator. The selective generation of the alarm may be achieved by manually modifying one or more settings of the control module 212 related to activation of the alarm. The alarm may include auditory, visual, tactile feedback and/or a combination thereof provided by the control module 212 through the operator interface 216.

Additionally, the control module 212 is configured to selectively generate an event log based on the final de-rate value S6. The event log may include data relating to the de-rate occurrences of the engine 202 for different operational cycles of the engine 202. This data may include any one or a combination of, but not limited to, date, time, duration and amount of de-rate corresponding to the one or more de-rate occurrences. The event log may be selectively accessed by using a suitable electronic and/or electrical tool 218 configured to communicate with and access information stored in the database or the internal memory of the control module 212. The electronic tool 218 may also be configured to modify one or more settings of the control module 212 such as enabling activation or deactivation of the alarm, clearing the event log and so on. It should be noted that the event log and method to access the control module 212 described herein is merely exemplary and may vary as per system design and requirements, and may not limit the scope of the disclosure.

Figure 4:
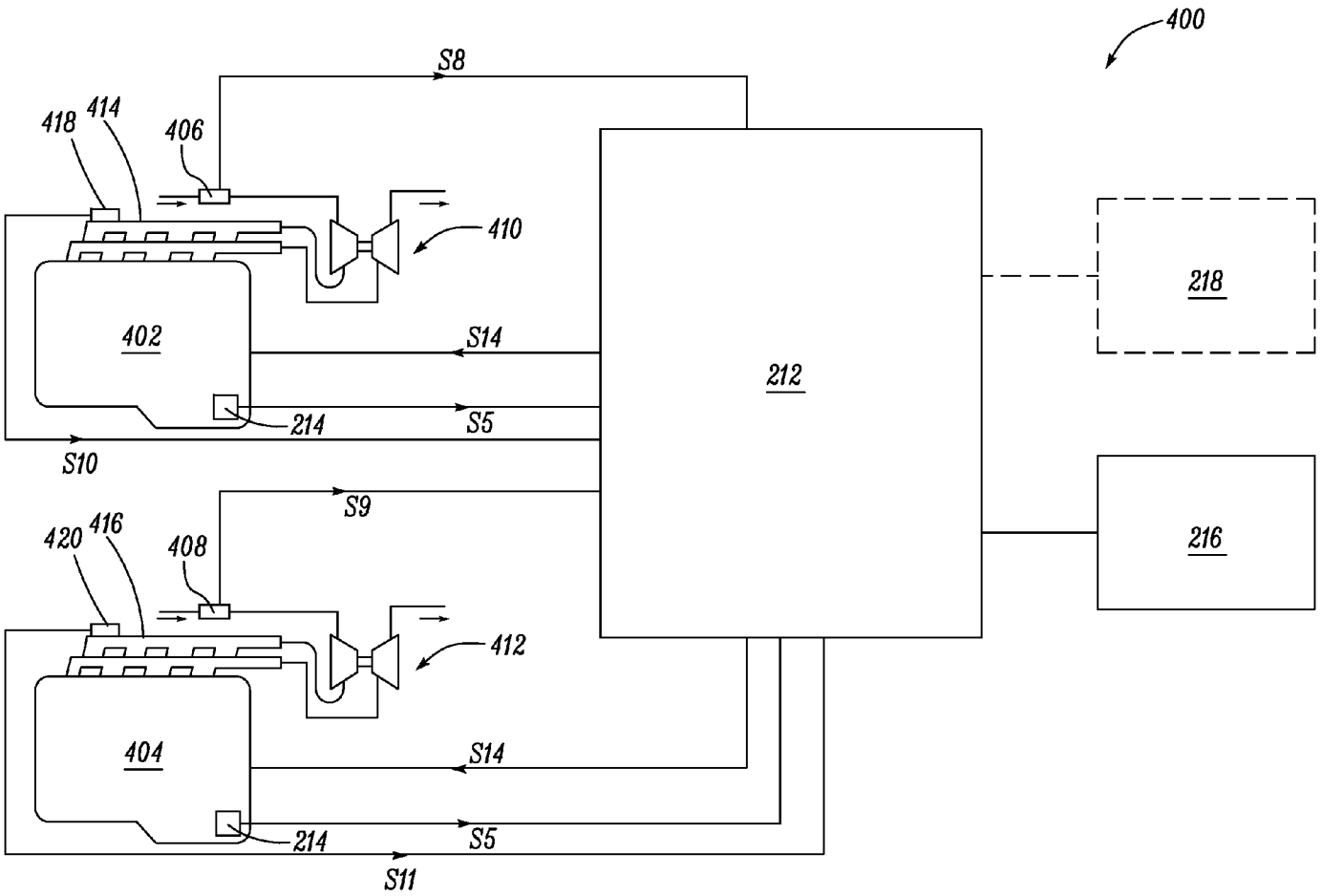
FIG. 4 is a block diagram of the control system for a dual engine system of the machine, according to an embodiment of the present disclosure.
Figure 5:
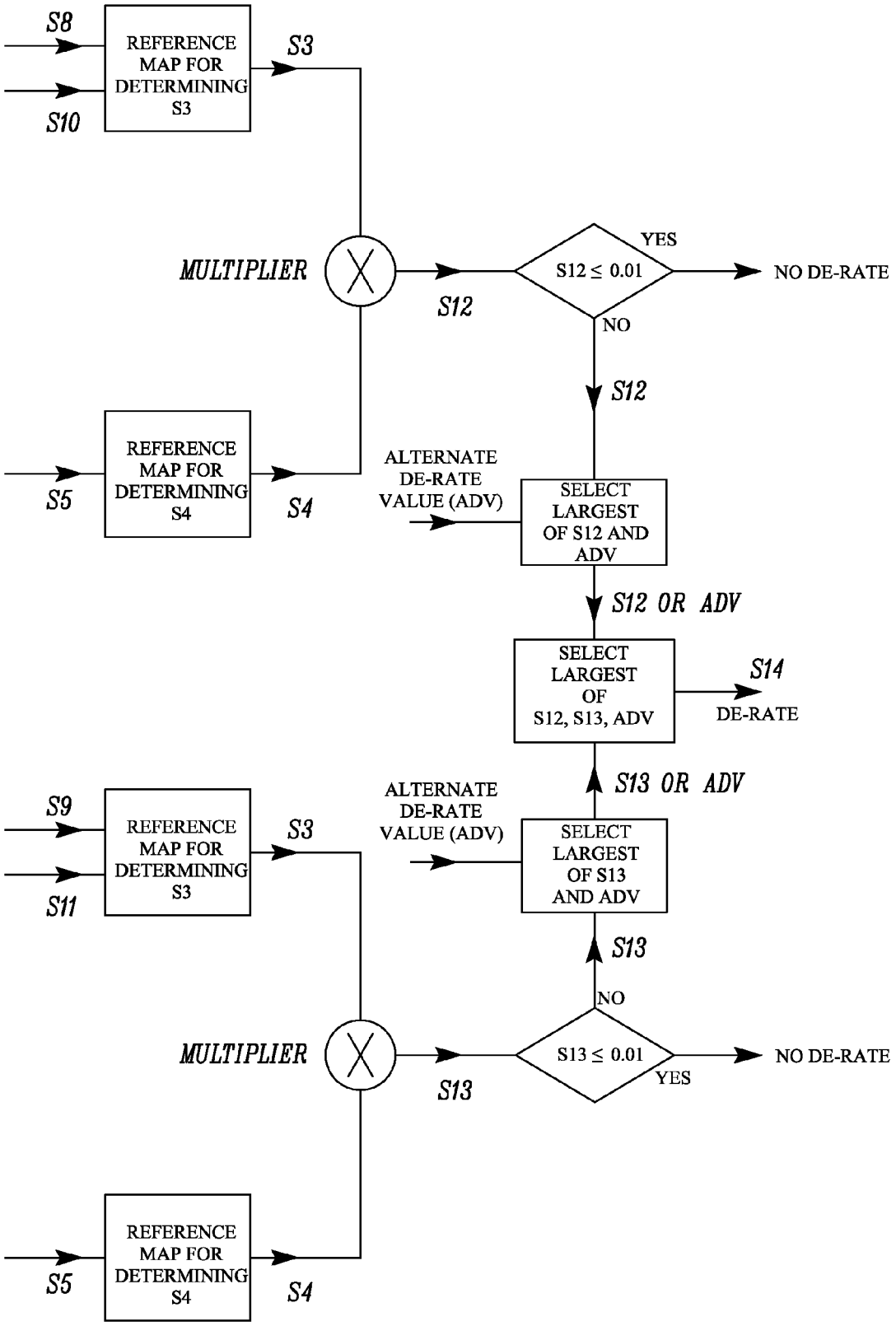
FIG. 5 is a control diagram for de-rating the dual engine system, according to an embodiment of the present disclosure.

In another embodiment, as shown in FIG. 4, the machine 100 may include a dual engine system such that a first engine 402 may be coupled to the first propeller 102 and a second engine 404 may be coupled to the second propeller 104. It should be noted that in other embodiments, the machine 100 may include a plurality of engines. Referring to FIG. 4, a block diagram of another exemplary control system 400 for the dual engine system is illustrated. Referring to FIG. 5, a control diagram for de-rating the dual engine system, according to an embodiment of the present disclosure is illustrated. More specifically, the control system 400 is configured to de-rate the first and second engines 402, 404 based on one or more parameters and will now be explained in detail with reference to FIGS. 4 and 5.

The first engine 402 includes a first inlet sensor 406. The first inlet sensor 406 is configured to generate a signal indicative of a first engine inlet air temperature S8 (hereinafter referred to as "the first inlet air temperature S8"). The second engine 404 includes a second inlet sensor 408. The second inlet sensor 408 is configured to generate a signal indicative of a second engine inlet air temperature S9 (hereinafter referred to as "the second inlet air temperature S9"). The first and second inlet air temperatures S8, S9 may refer to the ambient air temperature within the engine room of the machine 100. The engine room may be configured to house the first and second engines 402, 404 therein.

In an embodiment, where the first and second engines 402, 404 may be housed within the same engine room. The first and second inlet air temperatures S8, S9 may be equal to or different from each other based on ambient conditions within the engine room. For example, the first and second inlet air temperatures S8, S9 may be different due to a temperature gradient present within the engine room. In another embodiment, the first and second engines 402, 404 may be housed within different engine rooms. In such a case, the first and second inlet air temperatures S8, S9 may be different from each other. In yet another embodiment, where the first and second engines 402, 404 may be installed open to atmosphere, the first and second inlet air temperatures S8, S9 may refer to the temperature of atmosphere. In such an embodiment, the first and second inlet air temperatures S8, S9 may be equal to each other.

The first engine 402 and the second engine 404 may include a first turbocharger 410 and a second turbocharger 412 respectively. The first and second turbochargers 410, 412 may be configured to receive and compress the inlet air. The first and second turbochargers 410, 412 may be further fluidly coupled to a first intake manifold 414 and a second intake manifold 416 of the first and second engines 402, 404 respectively. The first and second intake manifolds 414, 416 may be configured to receive the inlet air after compression from the first and second turbochargers 410, 412 respectively. The compression of the inlet air may result in an increase in temperature of the inlet air. Accordingly, a first intake manifold sensor 418 and a second intake manifold sensor 420 is coupled to the first and second intake manifolds 414, 416 of the first and second engines 402, 404 respectively. The first and second intake manifold sensors 418, 420 are configured to generate a signal indicative of a first engine intake manifold air temperature S10, (hereinafter referred to as "the first intake manifold air temperature S10"), and a second engine intake manifold air temperature S11, (hereinafter referred to as "the second intake manifold air temperature S11"), respectively.

In an embodiment, the control module 212 is communicably coupled to the first inlet sensor 406, the second inlet sensor 408, the first intake manifold sensor 418 and the second intake manifold sensor 420. The control module 212 is configured to determine the first inlet air temperature S8, the second inlet air temperature S9, the first intake manifold air temperature S10 and the second intake manifold air temperature S11 based on the signals received from the first and second inlet sensors 406, 408 and the first and second intake manifold sensors 418, 420 respectively. It should be noted that the control system 400 may utilize sensors such as the first and second inlet sensors 406, 408, the first and second intake manifold sensors 418, 420 and the speed sensor 214 already installed within the system without a need of additional sensors.

Further, the control module 212 is configured to determine a first final de-rate value S12 corresponding to the first engine 402 and a second final de-rate value S13 corresponding to the second engine 404 in a similar methodology as described in relation with the single engine system. It should be noted that the control module 212 may also be configured to determine one or more first alternate de-rate values and/or second alternate de-rate values for the first and second engines 402, 404 based on one or more operational parameters. The operational parameters may include, but not limited to, any one or a combination of, the engine coolant temperatures and the fuel pressures. Additionally, the control module 212 is configured to determine a final common de-rate value S14 for the first and second engines 402, 404 based on a maximum of the first and second final de-rate values S12, S13 and the first and second alternate de-rate values for each of the first and second engines 402, 404 respectively. Based on the final common de-rate value S14, the control module 212 is configured to de-rate the first and second engines 402, 404 simultaneously.

INDUSTRIAL APPLICABILITY

De-rating of an engine is performed due to various reasons. De-rating may be performed in order to prevent overheating of the engine. For example, engines installed within closed environment, such as an engine room, need to be de-rated if the ambient temperature of the closed environment is high. In such a situation, the engines may de-rate after a cold start inside the hot closed environment, which may be undesirable.

Figure 6:
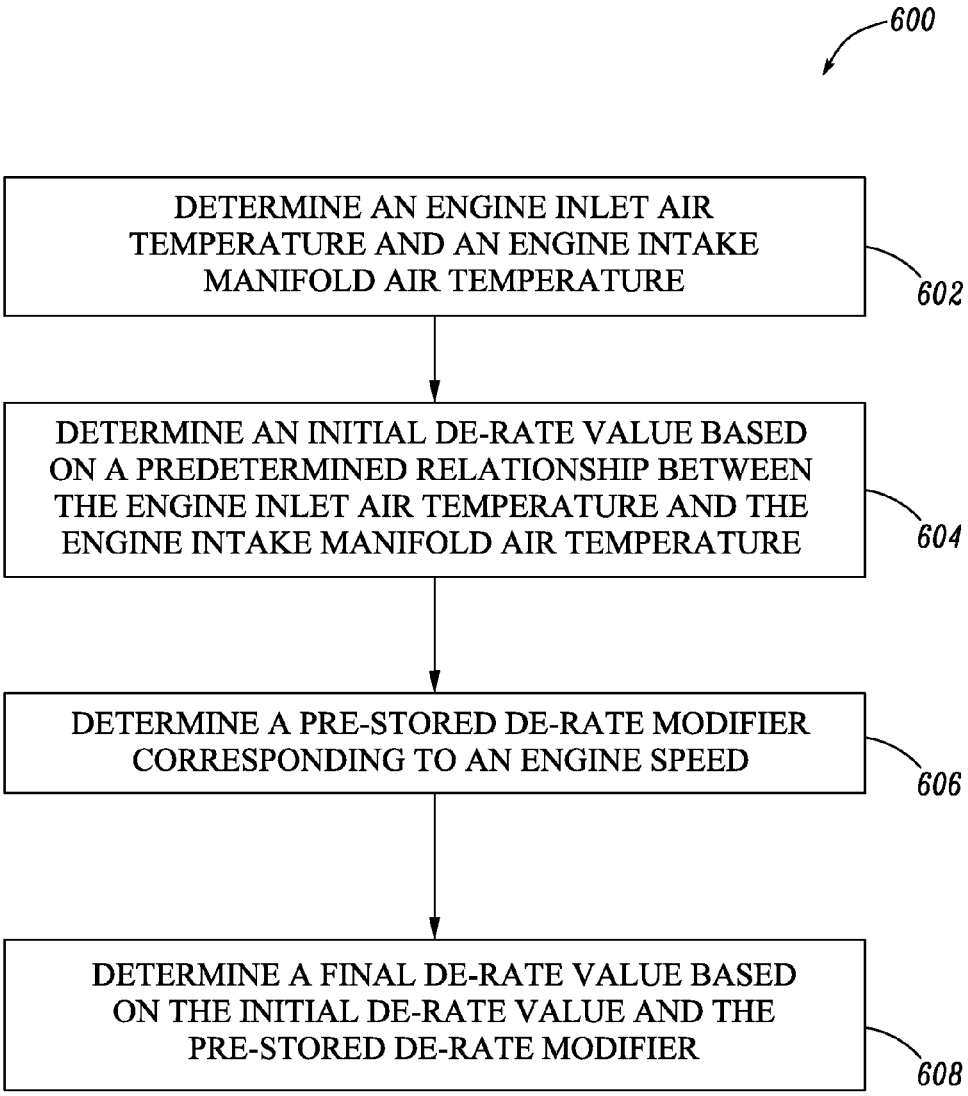
FIG. 6 is a flowchart of a method of working of the control system, according to an embodiment of the present disclosure.

The present disclosure relates to a method 600 for controlling the engine 202. Referring to FIG. 6, a flowchart of the method 600 is illustrated. At step 602, the control module 212 determines the inlet air temperature S1 and the intake manifold air temperature S2 based on the signals received from the inlet sensor 204 and the intake manifold sensor 210 respectively. At step 604, the control module 212 determines the initial de-rate value S3 based on the predetermined relationship between the inlet air temperature S1 and the intake manifold air temperature S2. The predetermined relationship may refer to the predetermined reference map stored in the database accessible by the control module 212 or the internal memory of the control module 212. The reference map may include predetermined readings of the initial de-rate values S3 corresponding to different inlet air temperatures S1 and the intake manifold air temperatures S2. In another embodiment, the predetermined relationship may be the predetermined mathematical equation. The mathematical equation may include the multiple polynomial regression model, the physics based model, the neural network model or any other model or algorithm known in the art. The control system 200 utilizes sensors such as the inlet sensor 204, the intake manifold sensor 210 and the speed sensor 214 already installed within the system without the need of additional sensors.

At step 606, the control module 212 determines the pre-stored de-rate modifier value S4 corresponding to the engine speed S5. In one embodiment, the control module 212 may refer to the predetermined reference map stored in the database or the internal memory of the control module 212. The reference map may include predetermined de-rate modifier values S4 for different engine speeds S5. In another embodiment, the pre-stored de-rate modifier value S4 may be determined using the predetermined mathematical equation. The mathematical equation may include the multiple polynomial regression model, the physics based model, the neural network model or any other model or algorithm known in the art.

The pre-stored de-rate modifier value S4 is set as zero below the predetermined engine speed. The predetermined engine speed may vary. For example, in one embodiment, the predetermined engine speed may equal to an idling speed of the engine 202. In another embodiment, the predetermined engine speed may be greater than the idling speed of the engine 202. The setting of the pre-stored de-rate modifier value S4 as zero below the predetermined engine speed may prevent de-rate of the engine 202 during starting of the engine 202 at low engine speeds S5 despite high ambient temperatures. This may improve an overall user experience.

At step 608, the control module 212 determines the final de-rate value S6 based on the initial de-rate value S3 and the pre-stored de-rate modifier value S4. The control module 212 may determine the final de-rate value S6 in different ways. In one embodiment, the control module 212 determines the final de-rate value S6 by multiplying the initial de-rate value S3 with the pre-stored de-rate modifier value S4. In another embodiment, the control module 212 may refer to the predetermined reference map stored in the database or the internal memory of the control module 212. The reference map may include predetermined readings of the final de-rate value S6 for different initial de-rate values S3 and the pre-stored de-rate modifier values S4. In yet another embodiment, the final de-rate value S6 may be determined using the predetermined mathematical equation.

The mathematical equation may include the multiple polynomial regression model, the physics based model, the neural network model or any other model or algorithm known in the art.

In one embodiment, the control module 212 sets the final de-rate value S6 to zero in the situation when the final de-rate value S6 is lower than the preset de-rate value S7. This may prevent de-rating of the engine 202 due to noise and/or residual values present in the system.

In one embodiment, the control module 212 may determine the alternate de-rate value based on one or more operational parameters. The operational parameters may include, but not limited to, any one or a combination of, the engine coolant temperature and the fuel pressure. In such an embodiment, the control module 212 de-rates the engine 202 based on the maximum of the final de-rate value S6 and the alternate de-rate value.

Based on the final de-rate value S6 or the alternate de-rate value, the control module 212 de-rates the engine 202. In one embodiment, the control module 212 may reduce the fuel supply to one or more cylinders of the engine 202 to de-rate the engine 202. In another embodiment, the control module 212 may completely shut off the fuel supply to the one or more cylinders of the engine 202 to de-rate the engine 202. In yet another embodiment, the control module 212 may reduce the fuel supply to the one or more cylinders and completely shut of the fuel supply to remaining cylinders of the engine 202 to de-rate the engine 202.

In one embodiment, the control module 212 selectively generates the alarm based on the final de-rate value S6 or the alternate de-rate value. The selective generation of the alarm may be achieved by manually modifying one or more settings of the control module 212 related to activation of the alarm. The alarm may include auditory, visual, tactile feedback and/or a combination thereof provided by the control module 212 through the operator interface 216.

Additionally, the control module 212 selectively generates the event log based on the final de-rate value S6. The event log may include data relating to the de-rate occurrences of the engine 202 for different operational cycles of the engine 202. This data may include any one or a combination of, but not limited to, date, time, duration and amount of de-rate corresponding to the one or more de-rate occurrences.

In another embodiment, where the machine 100 may include the dual engine system, the control module 212 determines the first inlet air temperature S8, the second inlet air temperature S9, the first intake manifold air temperature S10 and the second intake manifold air temperature S11 based on the signals received from the first and second inlet sensors 406, 408 and the first and second intake manifold sensors 418, 420 respectively. The control system 400 utilizes sensors such as the first and second inlet sensors 406, 408, the first and second intake manifold sensors 418, 420 and the speed sensor 214 already installed within the system without the need of additional sensors.

Further, the control module 212 determines the first final de-rate value S12 corresponding to the first engine 402 and the second final de-rate value S13 corresponding to the second engine 404 in the similar methodology as described in relation with the single engine system. The control module 212 may also determine one or more first alternate de-rate values and/or second alternate de-rate values for the first and second engines 402, 404 based on one or more operational parameters. The operational parameters may include, but not limited to, any one or a combination of, the engine coolant temperatures and the fuel pressures. Additionally, the control module 212 determines the final common de-rate value S14 for the first and second engines 402, 404 based on the maximum of the first and second final de-rate values S12, S13 and the first and second alternate de-rate values for each of the first and second engines 402, 404 respectively. Based on the final common de-rate value S14, the control module 212 de-rates the first and second engines 402, 404 simultaneously. The simultaneous de-rate of the first and second engines 402, 404 lowers the engine speed S5 of the first and second engines 402, 404 simultaneously and prevents undesirable change in path of the machine 100 due to different engine speeds S5.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A control system of an engine, the control system comprising:

at least one inlet sensor configured to generate a signal indicative of an engine inlet air temperature;

at least one intake manifold sensor configured to generate a signal indicative of an engine intake manifold air temperature; and a control module communicably coupled to the at least one inlet sensor and the at least one intake manifold sensor, the control module configured to:

determine the engine inlet air temperature and the engine intake manifold air temperature based on the signals;

determine an initial de-rate value based on a predetermined relationship between the engine inlet air temperature and the engine intake manifold air temperature;

determine a pre-stored de-rate modifier corresponding to an engine speed; and determine a final de-rate value based on the initial de-rate value and the pre-stored de-rate modifier.

2. The control system of claim 1, wherein the control module is further configured to determine the final de-rate value by multiplying the initial de-rate value with the pre-stored de-rate modifier.

3. The control system of claim 1, wherein the de-rate modifier is zero below a predetermined engine speed.

4. The control system of claim 3, wherein the predetermined engine speed is equal to or greater than an idling speed of the engine.

5. The control system of claim 1, wherein the control module is further configured to set the final de-rate value to zero if the final de-rate value is lower than or equal to a preset value.

6. The control system of claim 1, wherein the control system is associated with a plurality of engines, and wherein the control module is configured to:

determine the final de-rate values for each of the plurality of engines; and determine a final common de-rate value for the plurality of engines based on a maximum of the final de-rate values for each of the plurality of engines.

7. The control system of claim 1, wherein the control module is further configured to selectively generate an alarm based on the final de-rate value.

8. The control system of claim 1, wherein the control module is further configured to selectively generate an event log based on the final de-rate value.

9. The control system of claim 1, wherein the control module is further configured to:

receive de-rate values based on one or more other operational parameters of the engine; and de-rate the engine based on a maximum of the de-rate values and the final de-rate value.

10. The control system of claim 9, wherein the other operational parameters of the engine is one of an engine coolant temperature and a fuel pressure.

11. A method of controlling an engine, the method comprising:

determining an engine inlet air temperature and an engine intake manifold air temperature;

determining an initial de-rate value based on a predetermined relationship between the engine inlet air temperature and the engine intake manifold air temperature;

determining a pre-stored de-rate modifier corresponding to an engine speed; and determining a final de-rate value based on the initial de-rate value and the pre-stored de-rate modifier.

12. The method of claim 11 further comprises determining the final de-rate value by multiplying the initial de-rate value with the pre-stored de-rate modifier.

13. The method of claim 11, wherein the de-rate modifier is zero below a predetermined engine speed.

14. The method of claim 13, wherein the predetermined engine speed is equal to or below an idling speed of the engine.

15. The method of claim 11 further comprises setting the final de-rate value to zero if the final de-rate value is lower than or equal to a preset value.

16. The method of claim 11 further comprises controlling a plurality of engines, wherein controlling the plurality of engines comprises:

determining the final de-rate values for each of the plurality of engines; and determining a final common de-rate value for the plurality of engines based on a maximum of the final de-rate values for each of the plurality of engines.

17. The method of claim 11 further comprises selectively generating an alarm based on the final de-rate value.

18. The method of claim 11 further comprises:

receiving de-rate values based on one or more other operational parameters of the engine; and de-rating the engine based on a maximum of the de-rate values and the final de-rate value.

19. The method of claim 18, wherein the other operational parameters of the engine is one of an engine coolant temperature and a fuel pressure.

20. A method of controlling an engine, the method comprising:

determining an engine inlet air temperature and an engine intake manifold air temperature;

determining an initial de-rate value based on a predetermined relationship between the engine inlet air temperature and the engine intake manifold air temperature;

determining a pre-stored de-rate modifier corresponding to an engine speed;

determining a final de-rate value by multiplying the initial de-rate value with the pre-stored de-rate modifier;

receiving de-rate values based on one or more other operational parameters of the engine; and de-rating the engine based on a maximum of the de-rate values and the final de-rate value.

* * * * *